US010648248B2

(12) United States Patent
Strand et al.

(10) Patent No.: US 10,648,248 B2
(45) Date of Patent: May 12, 2020

(54) DEVICE AND METHOD FOR SLANTING A CONDUCTOR CASING

(71) Applicant: NeoDrill AS, Ålgård (NO)

(72) Inventors: Harald Strand, Ålgård (NO); Wolfgang Mathis, Sandnes (NO)

(73) Assignee: NeoDrill AS, Ålgård (NO)

( * ) Notice: Subject to any disclaimer, the term of this patent is extended or adjusted under 35 U.S.C. 154(b) by 158 days.

(21) Appl. No.: 15/745,289

(22) PCT Filed: Jul. 14, 2016

(86) PCT No.: PCT/NO2016/050158

§ 371 (c)(1),
(2) Date: Jan. 16, 2018

(87) PCT Pub. No.: WO2017/014644

PCT Pub. Date: Jan. 26, 2017

(65) Prior Publication Data

US 2019/0085645 A1 Mar. 21, 2019

(30) Foreign Application Priority Data

Jul. 22, 2015 (NO) ..... 20150958

(51) Int. Cl.
*E21B 17/14* (2006.01)
*E21B 33/043* (2006.01)
(Continued)

(52) U.S. Cl.
CPC ..... *E21B 17/14* (2013.01); *E21B 7/205* (2013.01); *E21B 33/035* (2013.01); *E21B 33/043* (2013.01); *E21B 41/08* (2013.01)

(58) Field of Classification Search
CPC ..... E21B 17/14; E21B 33/035; E21B 33/043; E21B 41/08; E21B 7/205
See application file for complete search history.

(56) References Cited

U.S. PATENT DOCUMENTS 3,899,032 A 8/1975 Rees et al.
4,258,800 A * 3/1981 Hipp ..... E21B 7/043 175/61
(Continued)

FOREIGN PATENT DOCUMENTS

GB 1399715 7/1975
NO 20140210 8/2015
(Continued)

OTHER PUBLICATIONS

Norwegian Search Report, Norwegian Patent Application No. 20150958, dated Feb. 19, 2016.
(Continued)

*Primary Examiner* — Caroline N Butcher
(74) *Attorney, Agent, or Firm* — Andrus Intellectual Property Law, LLP

(57) ABSTRACT

A device and a method are for slanting a conductor casing when establishing a petroleum well where a supporting pipe has been inserted into the seabed. The supporting pipe is arranged to receive the conductor casing. The supporting pipe is provided with a casing shoe at a vertical distance below it upper end portion, the casing shoe forming a through casing-shoe opening eccentric relative to the supporting pipe.

15 Claims, 3 Drawing Sheets

(51) Int. Cl.

| | |
|---|---|
| ***E21B 41/08*** | (2006.01) |
| ***E21B 33/035*** | (2006.01) |
| ***E21B 7/20*** | (2006.01) |

(56) References Cited

U.S. PATENT DOCUMENTS

| | | | | |
|---|---|---|---|---|
| 4,830,541 | A * | 5/1989 | Shatto | E02D 23/16<br>166/368 |
| 2003/0029620 | A1 * | 2/2003 | Strand | E21B 41/0007<br>166/367 |

FOREIGN PATENT DOCUMENTS

| | | |
|---|---|---|
| WO | 2001/65050 | 9/2001 |
| WO | 2014/116119 | 7/2014 |

OTHER PUBLICATIONS

International Search Report, PCT/NO2016/050158, dated Oct. 6, 2016.
Written Opinion and Reply, PCT/NO2016/050158, dated Oct. 6, 2016.
Written Opinion and Reply, PCT/NO2016/050158, dated Aug. 23, 2017.
International Preliminary Report on Patentability, PCT/NO2016/050158, dated Sep. 1, 2017.

* cited by examiner

DEVICE AND METHOD FOR SLANTING A CONDUCTOR CASING

CROSS-REFERENCE TO RELATED APPLICATIONS

This application is the U.S. national stage application of International Application PCT/NO2016/050158, filed Jul. 14, 2016, which international application was published on Jan. 26, 2017, as International Publication WO 2017/014644 in the English language. The International Application claims priority of Norwegian Patent Application No. 20150958, filed Jul. 22, 2015. The international application and Norwegian application are both incorporated herein by reference, in entirety.

FIELD

This invention relates to a device for slanting a conductor casing. More particularly, it relates to a device for slanting a conductor casing when establishing a petroleum well where a supporting pipe has been inserted into the seabed, the supporting pipe being arranged to receive the conductor casing, wherein the supporting pipe is provided with a casing shoe at a vertical distance below its upper end portion, the casing shoe forming a through casing-shoe opening eccentric relative to the supporting pipe. The invention also includes a method of slanting a conductor casing.

BACKGROUND

Terms like "upper" and "lower" refer to the positions of the various components in the position of application.

When petroleum wells are being established from the seabed, it is common first to insert a conductor casing into the seabed. The seabed often consists of relatively loose sediments. Drilling of the petroleum well itself is carried out via the conductor casing. A valve arrangement located above the seabed is connected to the well in such a way that loads from the valve arrangement, which may be of a considerable weight and dimension, are transmitted to the conductor casing. A good and secure mounting to the seabed is essential, especially for the conductor casing to be able to resist the prevailing fatiguing forces.

Experience has shown that conventional methods of attachment between the conductor casing and the seabed give an unreliable and often insufficient attachment. The applicant's Norwegian patent application 20140210 discloses a mounting of a conductor casing by means of a suction foundation, which is provided with a supporting pipe. The suction foundation with the supporting pipe is inserted into the seabed in a manner known per se. The conductor casing is moved further into the seabed via the supporting pipe. Filling cement slurry into the annulus that forms between the supporting pipe and the conductor casing is one way of providing a substantially improved and secure mounting of the conductor casing. Other ways of fixing it are also known.

By relatively shallow reservoirs, for example, it may be practical to divert the well pipes from the vertical direction as high up as possible below the seabed. This may be achieved by slanting at least a portion of the conductor casing.

The device according to NO 20140210 has not been adapted for conductor casing to be slanted.

WO0165050 A1 discloses a suction substructure arranged for use in the installation of at least one conductor casing string in at least one well on or in a seabed, wherein a conductor casing shoe is provided in the lower end of the conductor casing string. One embodiment comprises an inclined conductor casing string.

U.S. Pat. No. 4,258,800 discloses a conductor casing shoe provided in the lower end of a conductor casing string for deflecting a conductor in a desired direction, wherein the casing shoe opening is eccentric relative to an upper support pipe, wherein the center axis of the casing shoe is slanted relative to the center axis of the supporting pipe.

SUMMARY

The invention has for its object to remedy or reduce at least one of the drawbacks of the prior art or at least provide a useful alternative to the prior art.

The object is achieved through the features that are specified in the description below and in the claims that follow.

The invention makes it possible for a conductor casing to be slanted from right below the seabed. A supporting pipe is inserted into the seabed. At a vertical distance below the upper end portion of the supporting pipe, preferably near the lower end portion of the supporting pipe, a casing shoe is arranged. The casing shoe forms a through casing-shoe opening which is eccentric relative to the center axis of the supporting pipe. By moving the conductor casing into the seabed via the eccentric casing-shoe opening, the conductor casing may be inserted into the seabed at a slant relative to the supporting pipe. In a preferred embodiment, a suction foundation according to NO 20140210 with an associated supporting pipe is used.

A more reliable slanting is achieved by placing a guide plate at the upper end portion of the supporting pipe. The guide plate is formed with a guide opening extending through it, which may also be eccentric relative to the supporting pipe. When the casing-shoe opening and the guide opening are in the desired relative positions, the conductor casing may, when being inserted into the seabed via both the guide opening and the casing-shoe opening, be given a desired slant and direction.

After the conductor casing has been moved in a manner known per se, for example by means of impacts or vibration, to the desired depth, the guide plate may be removed.

It may be practical to use a two-part conductor casing comprising a lower, first conductor-casing portion and an upper, second conductor-casing portion. The first conductor-casing portion consists of a straight pipe and is the portion of the conductor casing that is inserted into the seabed. The second conductor-casing portion is a pipe bent in advance, extending from the first conductor-casing portion and up above the seabed. The slanted conductor casing thereby takes a vertical direction above the seabed where it is typically connected in such a way that loads from a valve arrangement, such as wellhead valves (a BOP), are transmitted to the conductor casing.

The conductor casing may be cemented to the supporting pipe and possibly connected to a supporting frame as is explained in the applicant's Norwegian patent application 20141427.

The invention is defined by the independent claims. The dependent claims define advantageous embodiments of the invention.

In a first aspect, the invention relates more specifically to a device for slanting a conductor casing when establishing a petroleum well wherein a suction foundation includes an outer jacket and a supporting pipe, the supporting pipe and the outer jacket being arranged to be inserted into the seabed, the supporting pipe being arranged to receive the conductor casing. The supporting pipe is provided with a casing shoe at a vertical distance below its upper end portion, the casing shoe forming a casing-shoe opening extending through it and being eccentric relative to the supporting pipe. The device is characterized in that that, at its upward-facing side, the casing shoe is given at least one sloping face, which is arranged to guide the conductor casing towards the casing-shoe opening.

Methods of inserting a supporting pipe into the seabed are known to a person skilled in the art and will not be described any further.

It is advantageous that the casing shoe is a relatively long way down into the supporting pipe to give the intended effect. In some cases, it may be suitable to place it under the lower portion of the supporting pipe.

The casing-shoe opening may consist of a bore in the casing shoe or of an opening between the casing shoe and the supporting pipe, for example.

The casing-shoe opening may have a center axis, which is slanted relative to a center axis of the supporting pipe.

A guide plate, having a through guide opening eccentric relative to the supporting pipe, may be releasably arranged at the upper portion of the supporting pipe. By positioning the eccentric casing-shoe opening and the eccentric guide opening in different radial directions relative to the center axis of the supporting pipe, the conductor casing may, when extending through the guide opening and the casing-shoe opening, be given a desired slant relative to the supporting pipe, in a predetermined direction.

The conductor casing may comprise a lower, first conductor-casing portion and an upper, second conductor-casing portion, the second conductor-casing portion being bent. The first conductor-casing portion is usually straight and constitutes the portion that is inserted into the seabed. The bent, second conductor-casing portion extends from the slanted first conductor-casing portion and takes a vertical direction above the seabed.

In some cases it is sufficient that the first and second conductor-casing portions are oriented towards each other in a communication-enabling manner, while, in other cases, they may be joined together, for example one being slid into the other, maybe with a seal between them. They may also be held together in a manner known per se, for example by means of so-called hydraulic swaging (hydraulic shrinking or expansion).

The conductor casing is typically designed, in a manner known per se, to be able to absorb loads from a valve arrangement at the seabed. The conductor casing may also be connected to a supporting frame, more specifically a wellhead-supporting frame, as described by the applicant in the applicant's Norwegian patent application 20141427.

In a second aspect, the invention relates more specifically to a method for slanting a conductor casing when establishing a petroleum well wherein a suction foundation includes an outer jacket and a supporting pipe, the supporting pipe and the outer jacket being arranged to be inserted into the seabed, the supporting pipe being arranged to receive the conductor casing, wherein the method comprises:

arranging a casing shoe at a vertical distance below the upper end portion of the supporting pipe, the casing shoe forming a through casing-shoe opening eccentric relative to the supporting pipe;

inserting the suction foundation into the seabed; and moving the conductor casing, slanted relative to the supporting pipe, through the casing-shoe opening and down into the seabed, characterized in that the method further includes the steps:

arranging a guide plate, which has a through guide opening eccentric relative to the supporting pipe, in a releasable manner at the upper portion of the supporting pipe;

moving the conductor casing, slanted relative to the supporting pipe, through the guide opening and the casing-shoe opening and down into the seabed.

The casing-shoe opening of the casing shoe, eccentric relative to the center axis of the supporting pipe, has the effect of enabling the conductor casing to be slanted in the supporting pipe before being inserted into the seabed.

When the conductor casing includes a lower, first conductor-casing portion and an upper, second conductor-casing portion, the method includes arranging the second conductor-casing portion, which is bent, in the supporting pipe and in such a way that it communicates with the first conductor-casing portion.

The method may include filling cement slurry between the supporting pipe and the conductor casing to support the conductor casing and, in a manner known per se, let the conductor casing absorb forces from a valve arrangement at the seabed, possibly also connecting the conductor casing to a supporting frame.

The device and method according to the invention enable the use of a conductor casing which is slanted in a desired direction from just below the seabed to a desired depth, taking a vertical direction above the seabed and, moreover, has a sufficient strength of attachment to absorb the prevailing forces.

BRIEF DESCRIPTION OF THE DRAWINGS

In what follows, an example of a preferred embodiment and method is described, which is visualized in the accompanying drawings, in which.

DETAILED DESCRIPTION OF THE DRAWINGS

Figure 1:
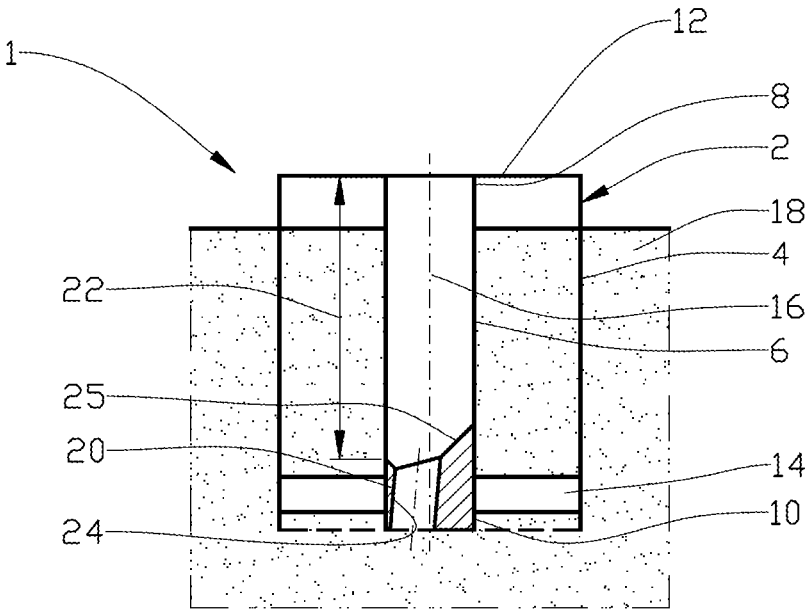
FIG. 1 shows a principle sketch, in vertical section, of a device according to the invention, the device having been inserted into the seabed.
Figure 2:
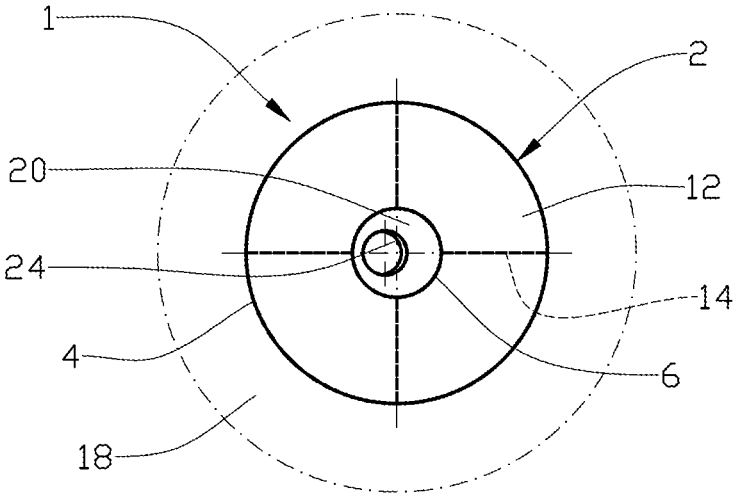
FIG. 2 shows a plan view of the device of FIG. 1.

In the drawings, the reference numeral 1 indicates a device, which comprises a suction foundation 2. The suction foundation 2 includes an outer jacket 4 and a supporting pipe 6, which is open both at an upper end portion 8 and at a lower end portion 10. A lid plate 12 sealingly connects the outer jacket 4 to the supporting pipe 6. A number of vertically set supporting plates 14 are arranged as well, encircling the supporting pipe 6 and connecting the supporting pipe 6 to the outer jacket 4 at the lower end portion 10 of the supporting pipe 6. In this exemplary embodiment, the outer jacket 4 and the supporting pipe 6 have a common center axis 16.

The suction foundation 2 is provided, in a manner known per se, with pump pipes, not shown, in order to be inserted into the seabed 18 to a position as shown in the figures. A casing shoe 20 is arranged at a vertical distance 22 under the upper end portion 8, preferably at the lower end portion 10 of the supporting pipe 6. The casing shoe 20 is formed with a casing-shoe opening 24 extending through it, here in the form of a somewhat slanted bore with a center axis 24*a* which is eccentric relative to the center axis 16 and thereby relative to the supporting pipe 6. The casing shoe 20 is formed, at its upward-facing side, with a sloping face 25 which is arranged to guide the conductor casing 30 towards the casing-shoe opening 24 when it is being moved against the casing shoe 20.

Figure 3:
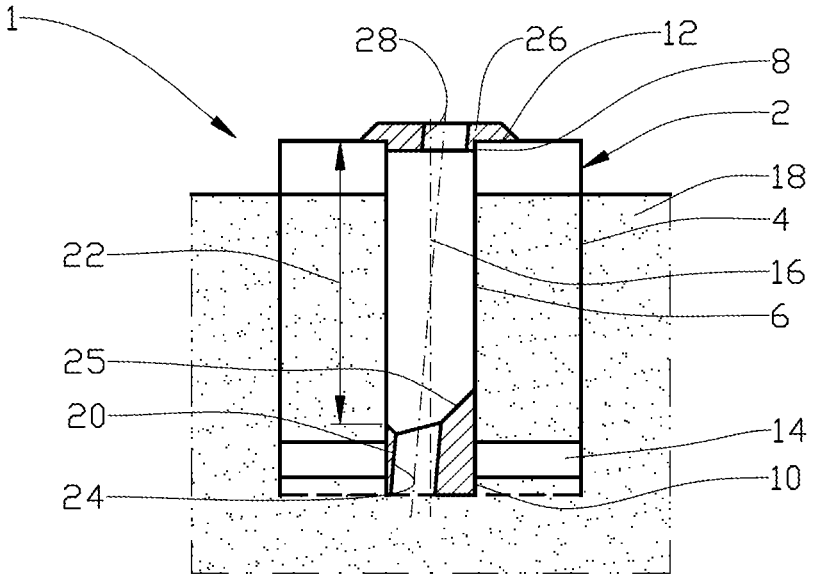
FIG. 3 shows the same as FIG. 1, but after a guide plate has been fitted.
Figure 4:
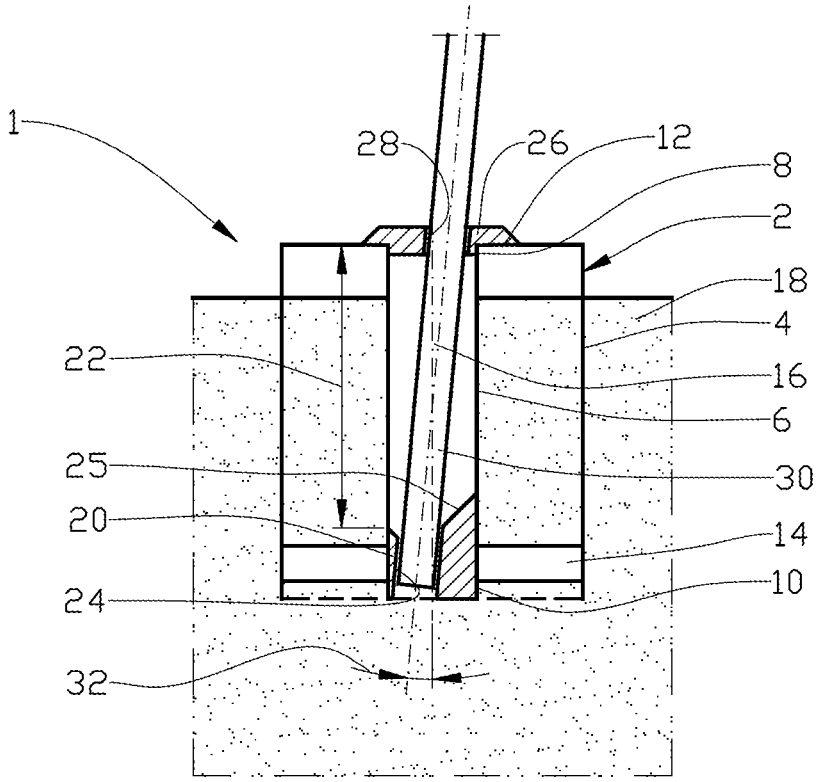
FIG. 4 shows the same as FIG. 3, but with a conductor casing placed in the device.

At the upper end portion 8 of the supporting pipe 6, a guide plat 26 with a guide opening 28 extending through it is arranged temporarily, as is shown in FIGS. 3 and 4.

When a conductor casing 30 is to be inserted into the seabed 18, the conductor casing 30 is placed in the supporting pipe 6, the conductor casing 30 initially extending through both the guide opening 28 and the casing-shoe opening 24, see FIG. 4. The guide opening 28 and the casing-shoe opening 24 are arranged in the desired radial directions relative to the center axis 16, which ensures that the conductor casing 30 will take a desired slant 32 in a desired direction.

Figure 5:
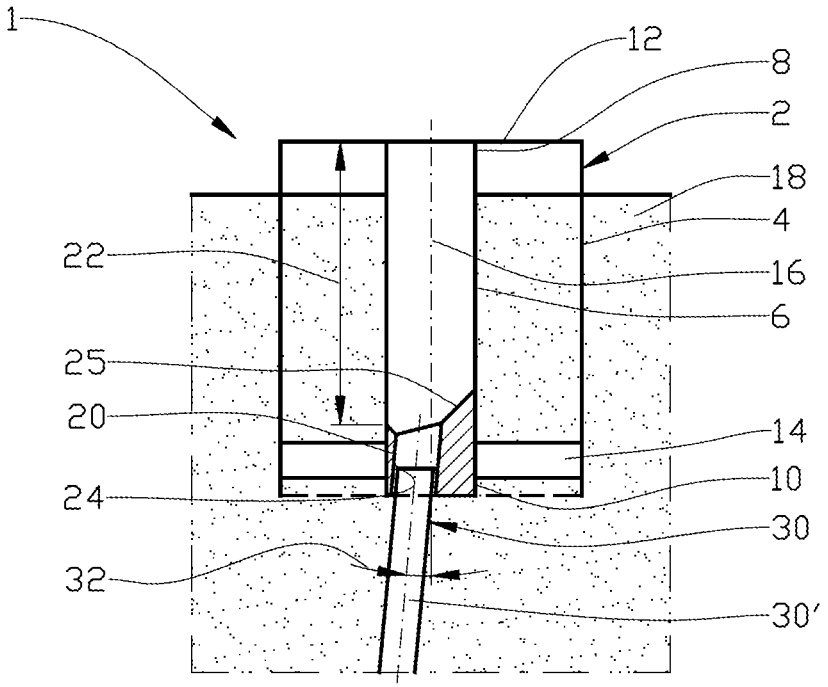
FIG. 5 shows the device after the conductor casing has been inserted into the seabed.
Figure 6:
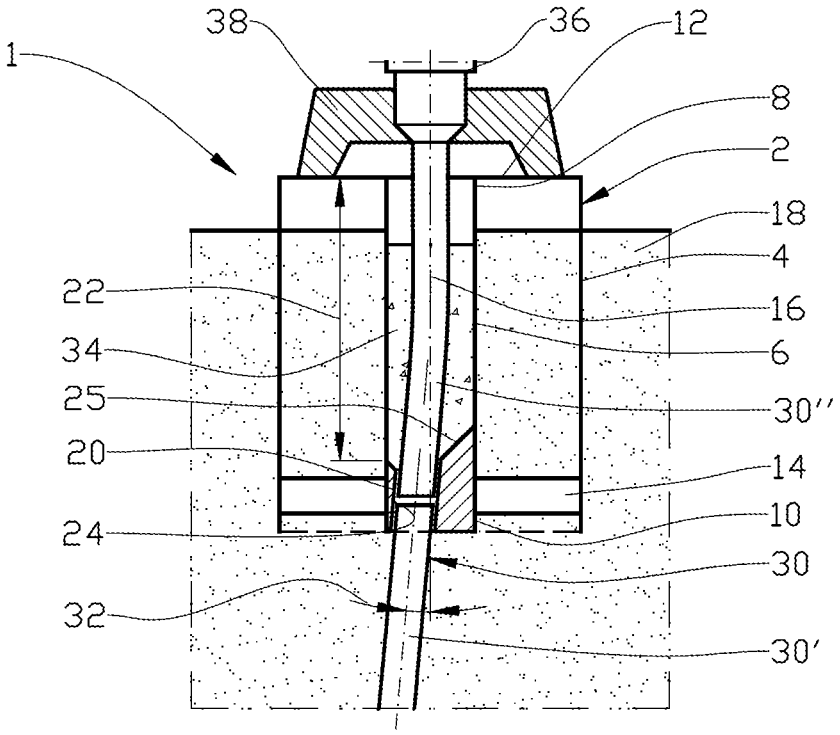
FIG. 6 shows the same as FIG. 5 after a second conductor casing has been installed in the device.

In FIG. 5, the conductor casing 30 has been inserted into the seabed 18 and the guide plate 26 has been removed. In the preferred embodiment, the conductor casing 30 includes a lower, first conductor-casing portion 30' which is straight and which forms the portion that is inserted into the seabed 18, and an upper, second conductor-casing portion 30" which is bent and which extends in a communication-enabling manner from the first conductor-casing portion 30' up above the seabed 18.

The conductor casing 30 may be attached to the supporting pipe 6, for example by cement slurry 34 being pumped in, forming concrete in the annulus between the supporting pipe 6 and the conductor casing 30. Via other well components not shown, the conductor casing 30 absorbs forces from a valve arrangement 36. In some cases, it may also be relevant to connect the conductor casing 30 to a supporting frame 38.

Using the suction foundation 1 constitutes a preferred embodiment, but the supporting pipe 6 may also be inserted into the seabed 18 in some other way.

It should be noted that all the above-mentioned embodiments illustrate the invention, but do not limit it, and persons skilled in the art may construct many alternative embodiments without departing from the scope of the attached claims. In the claims, reference numbers in parentheses are not to be regarded as restrictive. The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A device for slanting a conductor casing when establishing a petroleum well wherein a suction foundation includes an outer jacket and a supporting pipe, the supporting pipe and the outer jacket being arranged to be inserted into the seabed, the supporting pipe being arranged to receive the conductor casing, wherein the supporting pipe is provided with a casing shoe at a vertical distance below an upper end portion of the supporting pipe, the casing shoe forming a through casing-shoe opening eccentric relative to the supporting pipe, wherein at its upward-facing side, the casing shoe is given at least one sloping face which is arranged to guide the conductor casing towards the casing-shoe opening.

2. The device according to claim 1, wherein the casing-shoe opening has a center axis which is slanted relative to a center axis of the supporting pipe.

3. The device according to claim 1, wherein a guide plate which has a through guide opening eccentric relative to the supporting pipe is releasably arranged at the upper end portion of the supporting pipe.

4. The device according to claim 3, wherein the conductor casing, when extending through the guide opening and the casing-shoe opening is slanted relative to the supporting pipe.

5. The device according to claim 1, wherein the conductor casing comprises a lower, first conductor-casing portion and an upper, second conductor-casing portion, the second conductor-casing portion being bent.

6. The device according to claim 1, wherein the conductor casing is formed to absorb loads from a valve arrangement at the seabed.

7. The device according to claim 1, wherein the conductor casing is connected to a supporting frame.

8. A method for slanting a conductor casing when establishing a petroleum well wherein a suction foundation includes an outer jacket and a supporting pipe, the supporting pipe and the outer jacket being arranged to be inserted into the seabed, the supporting pipe being arranged to receive the conductor casing, wherein the method comprises:

arranging a casing shoe at a vertical distance below an upper end portion of the supporting pipe, the casing shoe forming a through casing-shoe opening eccentric relative to the supporting pipe;

inserting the suction foundation into the seabed;

arranging a guide plate, which has a through guide opening eccentric relative to the supporting pipe, in a releasable manner at the upper portion of the supporting pipe; and moving the conductor casing, slanted relative to the supporting pipe, through the guide opening and the casing-shoe opening and down into the seabed.

9. The method according to claim 8, wherein the method, when the conductor casing comprises a lower, first conductor-casing portion and an upper, second conductor-casing portion, includes arranging the second conductor-casing portion, which is bent, in the supporting pipe.

10. The method according to claim 8, wherein the method includes filling cement slurry between the supporting pipe and the conductor casing.

11. The method according to claim 8, wherein the method includes letting the conductor casing absorb loads from a valve arrangement at the seabed.

12. The method according to claim 8, wherein the method includes connecting the conductor casing to a supporting frame.

13. A system for establishing a petroleum well, the system comprising:

a supporting pipe defining a central axis; and a casing shoe defining a casing-shoe opening, the casing shoe configured to be situated below a seabed at a lower end portion of the supporting pipe;

wherein a central axis of the casing-shoe opening is eccentric relative to the central axis of the supporting pipe, and wherein the casing-shoe opening is configured to permit passage of a conductor casing therethrough into the seabed at a slant relative to the central axis of the supporting pipe.

14. The system according to claim 13, further comprising a plurality of supporting plates encircling the supporting pipe.

15. The system according to claim 14, further comprising an outer jacket, wherein the plurality of supporting plates couple the supporting pipe to the outer jacket at the lower end portion of the supporting pipe.

* * * * *